US009309079B1

(12) United States Patent
Lam

(10) Patent No.: US 9,309,079 B1
(45) Date of Patent: Apr. 12, 2016

(54) BOTTOM TAPING TAPE ROLL REPLACEMENT

(71) Applicant: LAMUS ENTERPRISES INC., Vancouver (CA)

(72) Inventor: Joe Augustine S. T. Lam, Vancouver (CA)

(73) Assignee: LAMUS ENTERPRISES INC., Vancouver, BC (CA)

( * ) Notice: Subject to any disclaimer, the term of this patent is extended or adjusted under 35 U.S.C. 154(b) by 0 days.

(21) Appl. No.: 14/520,409

(22) Filed: Oct. 22, 2014

(51) Int. Cl.

| | |
|---|---|
| ***B31F 1/00*** | (2006.01) |
| ***B65B 51/06*** | (2006.01) |
| ***B29C 65/00*** | (2006.01) |
| ***B44C 7/00*** | (2006.01) |
| ***B65H 19/12*** | (2006.01) |
| ***B65H 35/00*** | (2006.01) |

(52) U.S. Cl.

CPC ..... *B65H 19/12* (2013.01); *B65B 51/06* (2013.01); *B65B 51/067* (2013.01); *B65H 35/0013* (2013.01); *B65H 35/0026* (2013.01); *B65H 35/0033* (2013.01); *B31B 2201/6073* (2013.01); *B31B 2201/6078* (2013.01); *B31B 2201/6082* (2013.01); *B65H 2402/10* (2013.01); *B65H 2402/31* (2013.01); *B65H 2402/32* (2013.01); *B65H 2402/441* (2013.01); *B65H 2402/442* (2013.01); *B65H 2402/46* (2013.01); *B65H 2402/515* (2013.01); *B65H 2402/5155* (2013.01); *B65H 2402/61* (2013.01); *B65H 2402/64* (2013.01); *Y10T 156/1348* (2015.01); *Y10T 156/1707* (2015.01); *Y10T 156/1795* (2015.01); *Y10T 156/1798* (2015.01)

(58) Field of Classification Search

CPC ..... B65H 35/0013; B65H 51/06; B65H 35/0026; B65H 43/02; B65H 43/08; B65H 2402/10; B65H 2402/31; B65H 2402/32; B65H 2402/441; B65H 2402/442; B65H 2402/46; B65H 2402/515; B65H 2402/5155; B65H 2402/61; B65H 2402/64; B65H 35/0033; B65B 51/067; B65B 51/06; B31B 2201/6073; B31B 2201/6078; B31B 2201/6082; Y10T 156/1707; Y10T 156/1795; Y10T 156/1348; Y10T 156/1798

See application file for complete search history.

(56) References Cited

U.S. PATENT DOCUMENTS

| | | | | |
|---|---|---|---|---|
| 7,069,971 | B1 * | 7/2006 | Sheng | B65H 35/06 156/574 |
| 7,555,874 | B2 * | 7/2009 | Chu | B65B 59/02 493/183 |
| 8,434,539 | B2 | 5/2013 | Lam | |
| 2009/0084504 | A1 * | 4/2009 | Lam | B65B 51/067 156/538 |
| 2009/0218048 | A1 * | 9/2009 | Fox | B65B 51/067 156/468 |

FOREIGN PATENT DOCUMENTS

| | | | | |
|---|---|---|---|---|
| EP | 0502276 | A2 * | 9/1992 | B65B 51/067 |

* cited by examiner

*Primary Examiner* — Alex Efta

(57) ABSTRACT

A bottom tape applicator that facilitates changing of large diameter tape rolls is provided that is composed of a stationary frame mounted in the machine and through which a full roll of tape may be passed and that mounts a detachable unit that is replaced to replace the tape roll and a base unit movable between an open position and an operative position. The base unit combines with the detachable unit mounted in operative position in the stationary frame to form an operative tape applicator.

4 Claims, 4 Drawing Sheets

BOTTOM TAPING TAPE ROLL REPLACEMENT

FIELD OF INVENTION

The present invention relates to an improved replacement system for changing the tape roll in a bottom tape applicator that accommodates large tape rolls.

BACKGROUND OF THE PRESENT INVENTION

There are mainly two sealing methods used in the carton packaging industry; namely hot melt (or cold glue) adhesive and pressure sensitive tape. Cold glue or hot melt systems can provide non-stop sealing operation as the adhesive supply tank can be replenished without stopping the machine which provides a significant advantage in reducing production down time. Down time in taping machines is in part determined by the size of the tape roll as the machine has to be stop periodically to replace a depleted tape roll with a new roll.

Regardless of this disadvantage, it is estimated that about 50% of case sealing operations use pressure sensitive tape, since it provides other benefits, such as low equipment capital cost; easy open and re-tape; dust-proof; etc. In general, tape is preferable particularly in the foods and pharmaceuticals industry.

In order to reduce the down time associated with carton taping, significantly larger diameter tape rolls are being produced to thereby increase tape length e.g. from 900 M (10" diameter) to 2000 M (15"diameter) and when the large roll is used to effectively reduce the production down time by half.

U.S. Pat. No. 8,434,539 granted May 7, 2013 to Lam (the the disclosure of which is incorporated herein by reference) teaches a tape applicator which can be used to reduce the time required to change a tape roll by employing a removable insert with tape roll pre-installed the use of which can significantly reduce the time required to change a tape roll from about 1 minute as required for a conventional tape to about 15 seconds.

The tape applicator of the above referred to Lam patent works well with large tape roll (15" diameter) but only for top sealing, since the tape roll is positioned above the tape applicator, or the machine frame. The bottom taper on the other hand based on current technology is limited to the smaller diameter tape rolls as the tape roll has to be installed below the tape head or below the machine frame.

Conventional case taping machines usually provide a top and a bottom cavity to mount the tape applicators, these cavities are normally approximately 18" in length, 4" in width. Both top and bottom mounting cavity are only slightly larger than the tape applicators to be received therein.

Machines are usually compactly built with limited conveyor length. For this reason the tape applicator of the above Lam patent can only be used when applying a bottom tape with the small diameter tape roll and thus a conventional applicator without an insert has been used in machines where the larger tape rolls are to be employed.

BRIEF DESCRIPTION OF THE PRESENT INVENTION

It is an objective of the present invention to improve the technology disclosed in the said Lam Patent to permit the use of large diameter tape rolls in the bottom tape applicator.

It is a further object of the present invention to provide a bottom tape applicator that permits rapid replacement of large diameter tape rolls.

Broadly the present invention relates to a bottom tape applicator system comprising a stationary frame fixed to a frame of a taping machine, said stationary frame having a first and a second mounting, a passage through said stationary frame between said first and second mounting to permit a large tape roll to pass there through, said first mounting mounting a base unit that includes a rear wipe down of said bottom taping system and said second mounting mounting for easy slide in insertion and removal a detachable unit, said detachable unit including a front applicator of said tape applicator system and a tape roll mounting, a coupling on said rear wipe down and a cooperating coupling on said front applicator for mounting a large roll of tape, said second mounting being a slide in mounting to permit said detachable unit to be slid into place and to mount said detachable unit to position said cooperating coupler in position to engage with said coupler when base unit is moved into operative position on said first mounting, said coupler and said cooperating coupler when said base unit and said detachable unit are mounted on said first and second mountings respectively in operative position connecting said rear wipe down with said front applicator so that said front applicator and said rear wipe down act together to provide a complete bottom tape applicator to apply a bottom tape to a case.

Preferably, said first mounting pivotably mounts said base unit to said stationary frame adjacent to the end of said base unit remote from said detachable unit when said detachable unit is mounted on said second mounting and said first mounting includes cooperating stops on said base unit and said stationary frame to position said base unit in operative position on said stationary frame.

Preferably, said stationary frame includes a pair of parallel side walls each provided with an open ended slot and said detachable unit is provided with two pairs of spaced pins one pair projecting from each side of said detachable unit and aligned to cooperate with adjacent of said slots to provide said second mounting to slideably mount said detachable unit in operative position.

Preferably, said base unit when in said operative position locks said detachable unit in said second mounting.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
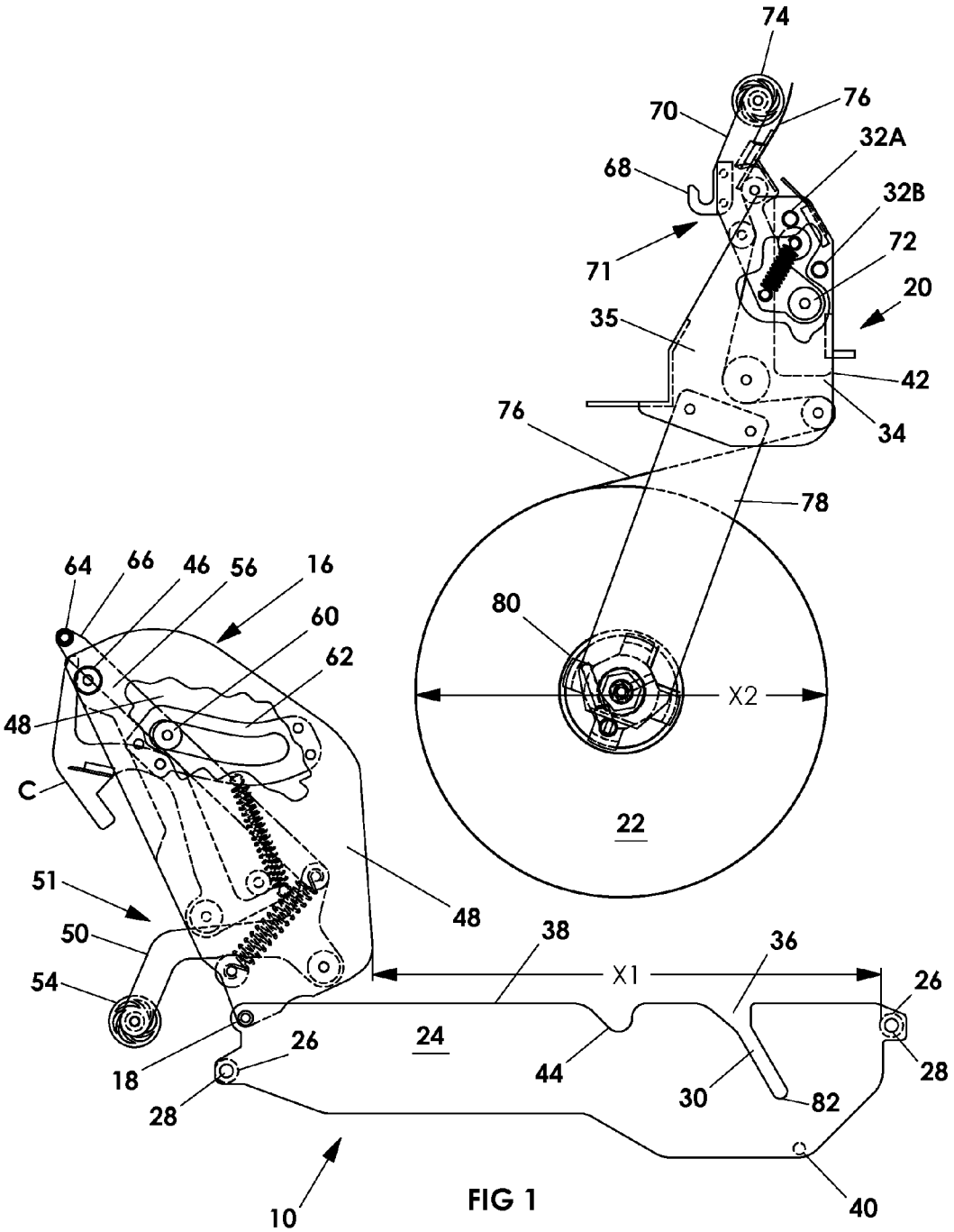
FIG. 1 is a side elevation showing the present invention with the base unit and detachable unit in position for inserting the detachable unit into operative position.

The basic components of the preset invention are the stationary frame 10 that is connected to the frame 12 of the taping machine 14 (see FIGS. 2, 3 and 4); the base unit 16 that in the illustrated arrangement is pivotably mounted on the stationary unit 10 on axle 18 (first mounting); and the detachable unit 20 that mounts the tape roll 22 that in the illustrations is a full tape roll that is to replace a depleted roll on a detachable unit 20 on which the depleted roll is mounted (not shown) and that has been removed from the stationary frame 10.

Figure 4:
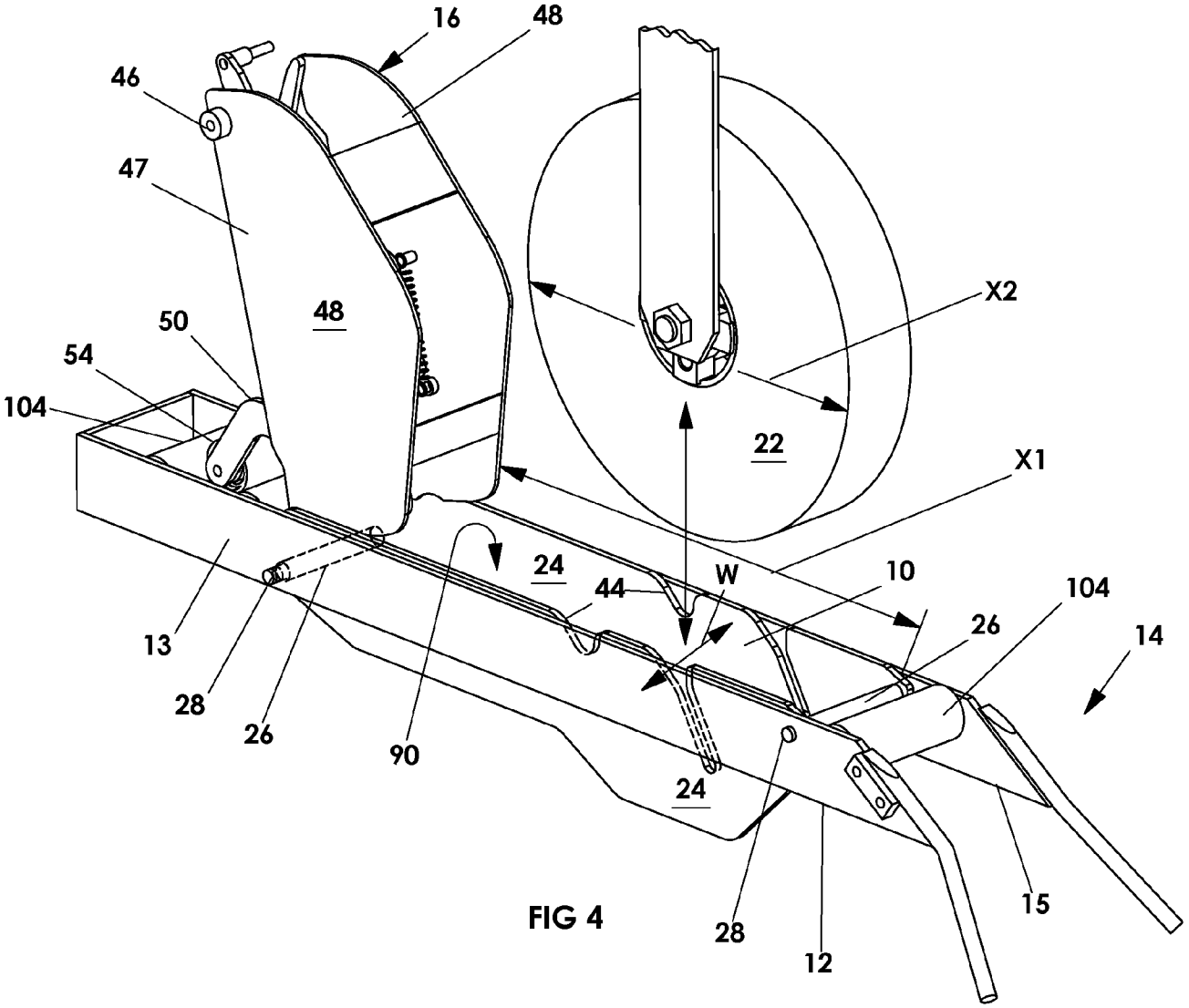
FIG. 4 is an isometric illustration with parts omitted further illustrating the stationary frame in the machine frame and the open cavity into which the detachable unit with a full tape roll may be inserted

The stationary frame 10 is composed of a pair of spaced parallel opposed side walls 24 that are essentially mirror images (see FIG. 4). The side walls 24 will normally be connected to adjacent elements of the machine frame 12 (see elements 13 and 15 in FIG. 4) and are sufficiently spaced apart by spacers 26 mounted on pins 28 that extend between the sidewalls 24 and space the walls 24 to receive the base unit 16 and the detachable unit 20 there between as will be described below. The pins 28 may also be used to mount the stationary frame to the machine frame 14. The axle 18 extends across the space between the walls 24 and each end of the axle 18 is mounted in its adjacent of said side walls 24.

Each side wall 24 is provided with an open ended mounting slot 30 the mouth 36 of which opens through the upper edge 38 of the wall 24 in which it is formed and that slopes downwardly away from the base unit 16. Each slot 30 receives an adjacent pair of spaced mounting pins 32A and 32B that project from the adjacent side wall 34 of a pair of opposed parallel side walls 34 that form part of a frame 35 of the detachable unit 20 (only one side wall 34 is shown and therefore only one pair of pins 32A and 32B have been shown but the opposite sides of the detachable unit 20 will be essentially the same i.e. a pair of pins 32A and 32B on each side of the frame 35 of the detachable unit 20) which combine with the slots 30 form the second mounting.

A stop pin 40 may also be provided on each of the walls 24 or extend between the walls 24 to help position the detachable unit 20 in the stationary frame 10 by engaging the adjacent edges 42 of the frame 35 or walls 34 of the detachable unit 20.

Also formed in each of the walls 24 along their respective upper edge 38 is a cut out or notch 44 that provides a seat into which the adjacent stop 46 on the base unit 16 is received to position the base unit 16 in operative position as will be described below.

The base unit 16 and detachable unit 20 interact in essentially the same manner as the corresponding stationary unit (14 in the patent equivalent to the base unit 16 herein) and detachable unit (12 equivalent to the detachable unit 20 herein) as described in detail in the said US Lam patent the disclosure of which has been incorporated herein by reference and to which one may refer for more details on the structure and interaction of the base unit 16 and detachable unit 20.

The base unit 16 has frame 47 that includes a pair of spaced parallel side walls 48 between which the active parts of the base unit 16 are mounted and outward from which the stops 46 project. The operating parts which form the rear wipe down 51 include wipe down arm 50 pivotably mounted as indicated at 52 on at least one of the walls 48 and having a wipe down roll 54 mounted adjacent to one end of the arm 50 at one side of the mounting 52. A push bar 56 is pivotably connected to the arm 50 as indicated at 58 adjacent to its end on the opposite side of mounting 52 relative to the roll 54. The movement of the push bar 56 is controlled by the interaction of the bearing 60 mounted thereon with the cam 62 fixed to one of the walls 48. A coupling pin 64 is mounted adjacent to the free end 66 of the push bar 56 remote from the connection 58. The coupling pin 64 engages in bushing 68 on applicator arm 70 which forms a part of eh front applicator 71 on the detachable unit 20 thereby to couple the wipe down 51 and front applicator 71 together to provide the required action for the taping operation (see FIG. 3).

A suitable cut off mechanism C is also mounted on at least one of the wall 48 of frame 47 of the base unit 16 to cut the tape 76 in the normal manner.

The detachable unit 20 contains the front applicator 71 composed of front applicator arm 70 that is pivotably mounted as indicated at 72 to the frame 35 of the detachable unit 20. The applicator arm 70 is provided with an applicator roll 74 adjacent to its free end to apply the tape 76 to the case or carton 100 (see FIG. 3) being taped in the normal manner. Also fixed to the frame 35 of unit 20 is a mast 78 on which a roll of tape 22 from which the tape 76 is drawn is mounted on hub 80 in the normal manner.

Figure 2:
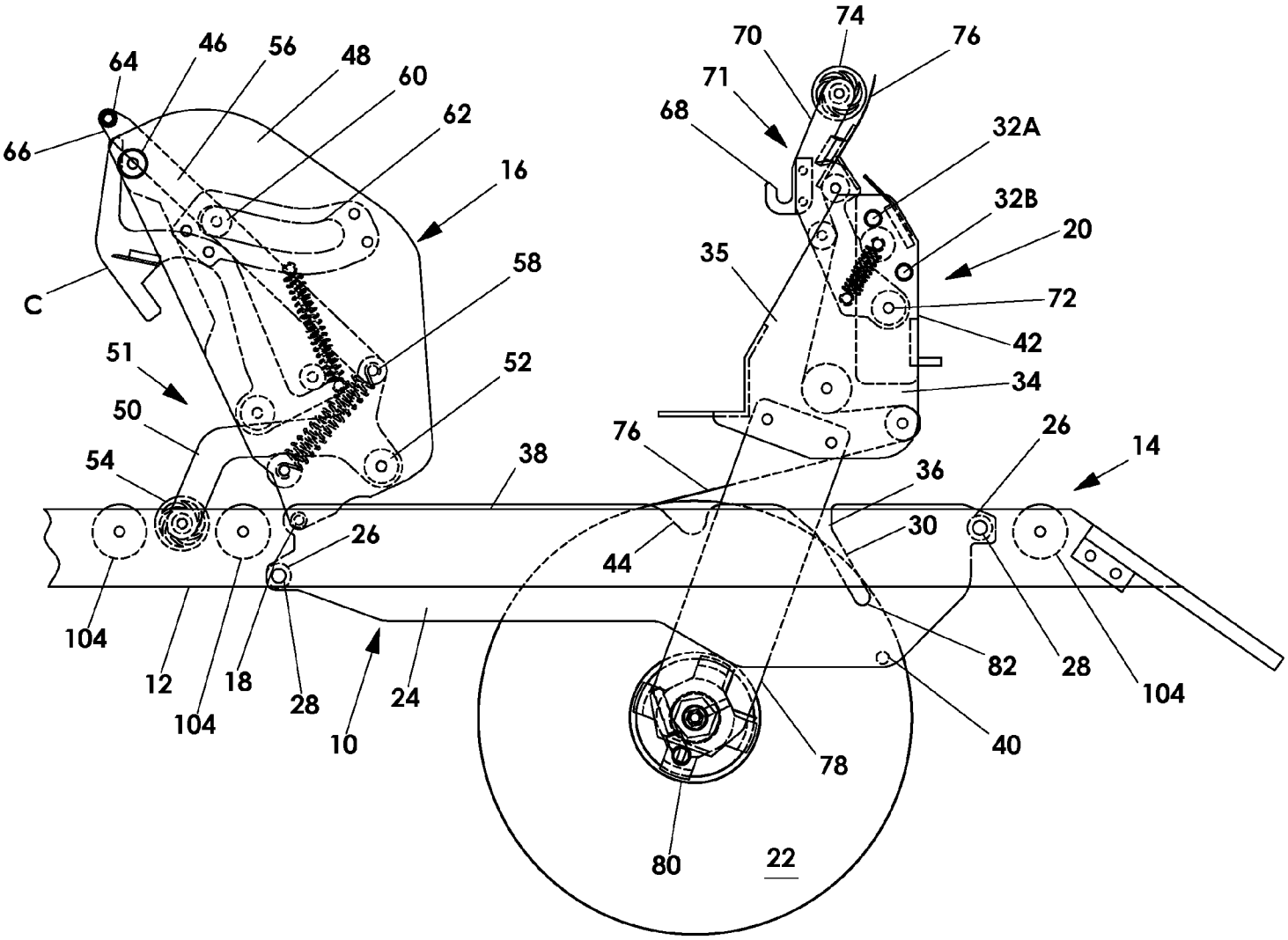
FIG. 2 is a side elevation similar to FIG. 1 showing the present invention with detachable unit part way inserted into operative position.

The base unit 16 pivoted upwardly and away from the detachable unit 20 on axle 18 to the open position is shown in FIGS. 1, 2 and 4. The base unit is moved to this position when a depleted roll is to be replaced i.e. the base unit 16 is pivoted to the position shown in FIG. 1 which disconnects the coupling pin 64 from the bushing 68 thereby uncoupling the base unit 16 and the detachable unit 20 and moves to a position that frees the detachable unit 20 with a depleted roll (not shown) to be lifted from the stationary frame 10. A replacement detachable unit 20 with a full or replacement tape roll 22 mounted thereon (as shown in FIG. 1) and having an outside diameter X2 is moved to position the unit 20 relative to the stationary frame 10 which as illustrated with the base unit 16 pivoted out of the way as shown in FIGS. 1 and 4 provides a clear passage 90 (see FIG. 4) with a length X1 which will be greater than the diameter X2 of a full roll i.e. longer that 15 inches for the conventional large full roll. Obviously the width W of the passage 90 measured perpendicular to the dimension X1 will be sufficient to accommodate the width of units 16 and 20.

The replacement roll 22 on the replacement detachable unit 20 is moved through the passage 90 and the pairs of pins 32A and 32B on opposite sides of eh frame 35 of the detachable unit 20 are slid into the slots 30 on opposite sides of the stationary frame 10 and moved along these slots 30 downwardly and away from the base unit 16 until the lower pin 32B contacts the bottom 82 of the slot 30 into which it is inserted and the pin 40 (if provided) engages the edge 42 of the sides or frame 34.

With the detachable unit 20 positioned in the stationary frame 10 as described the base unit 16 is pivoted on axle 18 to move the rear wipe down mechanism composed of the arm 50 wipe down roll 54, etc., into operate position and have the coupling in the form of pin 64 engage the cooperating coupling in the form of bushing 68 to couple the wipe down with the front applicator 71 so that the base unit 16 and detachable unit 20 operate together to apply a tape to a carton.

Figure 3:
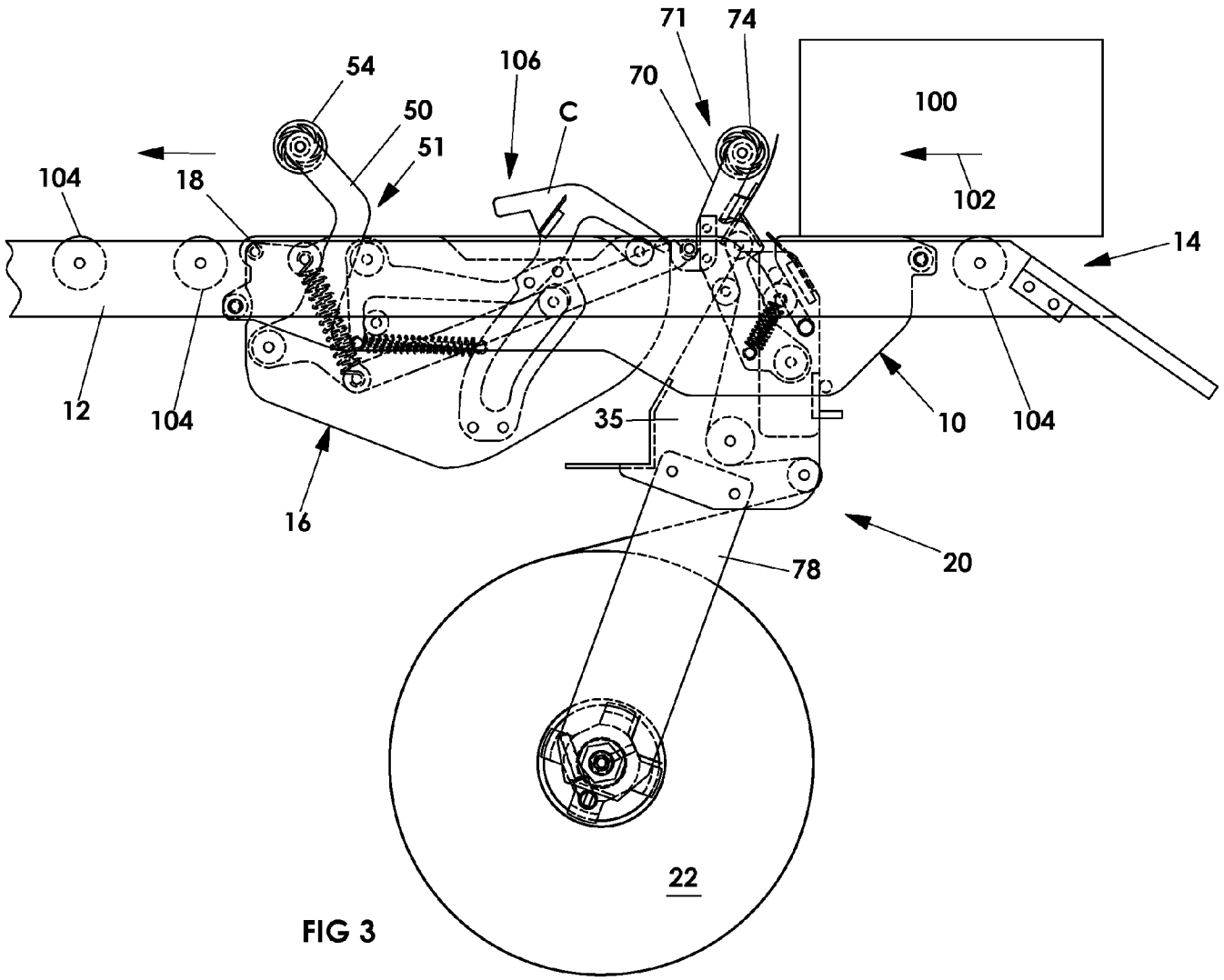
FIG. 3 is a side elevation similar to FIG. 1 showing the present invention with the base unit and detachable unit in their operative positions.

Moving the base unit into this operative position as shown in FIG. 3 and coupling the pin 64 with the bushing 66 in effect locks the detachable unit 20 in position until the base unit 16 is moved from its operative position for taping and then into a position where removal of the detachable unit 20 to change the tape roll 22 is possible.

As shown in FIG. 3 the carton or case 100 is moved in the direction of the arrow 102 by a suitable conveyer (not shown) to move the case 100 supported by the rollers 104 so that the tape applicator 106 formed by the coupling of the base unit 16 and the detachable unit 20 into an operating tape applicator 106 may apply a bottom taping operation applying tape 68 to the bottom of the case 100.

While specific forms of first and second mountings have been shown these mounting may take any suitable form.

Having described the invention, modifications will be evident to those skilled in the art without departing from the scope of the invention as defined in the appended claims.

The invention claimed is:

1. A bottom tape applicator system comprising a stationary frame fixed to a frame of a taping machine, said stationary frame having a first and a second mounting, a passage through said stationary frame between said first and second mounting to permit a tape roll to pass there through, said first mounting pivotably mounting a base unit to said stationary frame adjacent to an end of said base unit, said base unit including a rear wipe down of said bottom taping system, said second mounting providing for slide in insertion and removal of a detachable unit into and out of position on said stationary frame, said detachable unit including a front applicator of said tape applicator system and a tape roll mounting, said end of said base unit being remote from said detachable unit when said detachable unit is mounted on said stationary frame on said second mounting, said stationary frame includes a pair of parallel side walls each provided with an open ended slot and said detachable unit is provided with two pairs of spaced pins one pair projecting from each side of said detachable unit and aligned to cooperate with said slots to provide said second mounting to slideably mount said detachable unit in operative position, a coupling on said rear wipe down and a cooperating coupling on said front applicator, said second mounting positioning said detachable unit so that said cooperating coupling is in position to engage with said coupling when said detachable unit is mounted on said second mounting and said base unit is pivoted into operative position on said first mounting, said coupling and said cooperating coupling when said base unit and said detachable unit are mounted on said first and second mountings respectively in operative position connecting said rear wipe down with said front applicator so that said front applicator and said rear wipe down act together to provide a complete bottom tape applicator to apply a bottom tape to a case.

2. The bottom tape applicator system as defined in claim 1 wherein said first mounting includes cooperating stops on said base unit and said stationary frame to position said base unit in operative position on said stationary frame.

3. The bottom tape applicator system as defined in claim 1 wherein said base unit when in said operative position locks said detachable unit in said second mounting.

4. The bottom tape applicator system as defined in claim 2 wherein said base unit when in said operative position locks said detachable unit in said second mounting.

* * * * *